US005727971A

United States Patent [19]

Junkins et al.

[11] Patent Number: 5,727,971

[45] Date of Patent: Mar. 17, 1998

[54] SHIELDED CABLE ASSEMBLY

[75] Inventors: Michael Eugene Junkins, Dillsburg; Lawrence Michael Hibbert, Middletown, both of Pa.

[73] Assignee: The Whitaker Corporation, Wilmington, Del.

[21] Appl. No.: 653,372

[22] Filed: May 21, 1996

[51] Int. Cl.[6] ..... H01R 9/03

[52] U.S. Cl. ..... 439/610; 439/499

[58] Field of Search ..... 439/492, 497, 439/499, 607, 610

[56] References Cited

U.S. PATENT DOCUMENTS

| | | | |
|---|---|---|---|
| 4,537,458 | 8/1985 | Worth . | |
| 4,621,885 | 11/1986 | Szczesny et al. . | |
| 4,714,435 | 12/1987 | Stipanuk et al. | 439/496 |
| 4,753,005 | 6/1988 | Hasircoglu | 29/829 |
| 5,122,079 | 6/1992 | Locati | 439/417 |
| 5,125,850 | 6/1992 | Locati | 439/404 |
| 5,174,782 | 12/1992 | Bogiel et al. | 439/404 |
| 5,195,909 | 3/1993 | Huss, Jr. et al. | 439/465 |

*Primary Examiner*—Khiem Nguyen
*Attorney, Agent, or Firm*—Gerald K. Kita

[57] ABSTRACT

A conducting fabric is applied as a wrapper (10) over insulated conductors (5) of a cable assembly (1), and conducting shells (12) clamp the wrapper (10) to provide an electrical shield (9), and at least one conducting fastener (17) is mounted in the shells (12) for coupling to a fastener coupling portion of a mating electrical connector.

8 Claims, 4 Drawing Sheets

SHIELDED CABLE ASSEMBLY

FIELD OF THE INVENTION

The present invention relates to a shielded cable assembly, and, more particularly, to a shielded cable assembly having multiple insulated conductors terminated with an electrical connector.

BACKGROUND OF THE INVENTION

A known electrical connector is disclosed in each of U.S. Pat. Nos. 5,122,079 and 5,125,850, wherein, the connector comprises, an insulating housing in which are electrical contacts, insulation penetrating terminals on the contacts project toward a termination cover, and the housing and termination cover close onto opposite sides of insulated electrical conductors, forcing the terminals to penetrate insulation on the conductors and electrically connect with respective electrical conductors. In the known connector, both the termination cover and the housing are insulating rather than being conductive. Thereby, the conductors terminated with the connector, together comprise an unshielded cable assembly. A shielded cable assembly will require a conducting shield over the exterior of the entire cable assembly.

A known shielded cable assembly is disclosed in U.S. Pat. No. 5,195,909, and comprises, conducting shell members stamped from sheet metal and shaped to enclose an insulating connector housing that terminates a shielded cable. A conducting staple attaches the shell members to a shield of the shielded cable. One of the disadvantages of the known shielded cable assembly resides in the cost of the staple, and its associated complexity of assembly involved in connecting the shell members, by way of the staple, to the shield of the shielded cable. Insulating backshells are required to enclose the shell members in place over the connector housing. A problem to be solved resides in providing a shielded cable assembly without a conducting staple and without additional backshells to hold conducting shell members in place over a connector housing.

SUMMARY OF THE INVENTION

According to the invention, a conducting wrapper encloses insulated conductors for an electrical cable where the conductors project from an insulating electrical connector that electrically terminates the conductors, and conducting shells are closed over the connector and the wrapper to establish a shield for the connector and the conductors.

According to an embodiment, the termination cover compresses the insulated conductors and the wrapper against at least one of the shells. An advantage resides in an electrical connection being established without a need for additional hardware.

According to an embodiment, the insulated conductors project from between the assembled termination cover and the housing, and the insulated conductors and the wrapper are routed between the termination cover and said at least one of the shells. An advantage is that the shell engages a large surface of the wrapper to provide an electrical shield.

According to an embodiment, the insulated conductors project from a side of the assembled termination cover and housing, and the insulated conductors and the wrapper are routed between, and are clamped between, the termination cover and at least one of the shells to provide a clamped electrical connection and a shield extending over both the housing and the insulated conductors.

According to an embodiment, the termination cover compresses the insulated conductors and the wrapper against at least one of the shells. An advantage resides in an electrical connection and shield being established by said compression of the wrapper.

According to an embodiment, at least one conducting fastener mounted in the shells for coupling to, and for electrical connection with, a fastener coupling portion of a mating electrical connector.

DESCRIPTION OF THE DRAWINGS

An embodiment of the invention will now be described by way of example with reference to the drawings, according to which.

DETAILED DESCRIPTION

Figure 1:
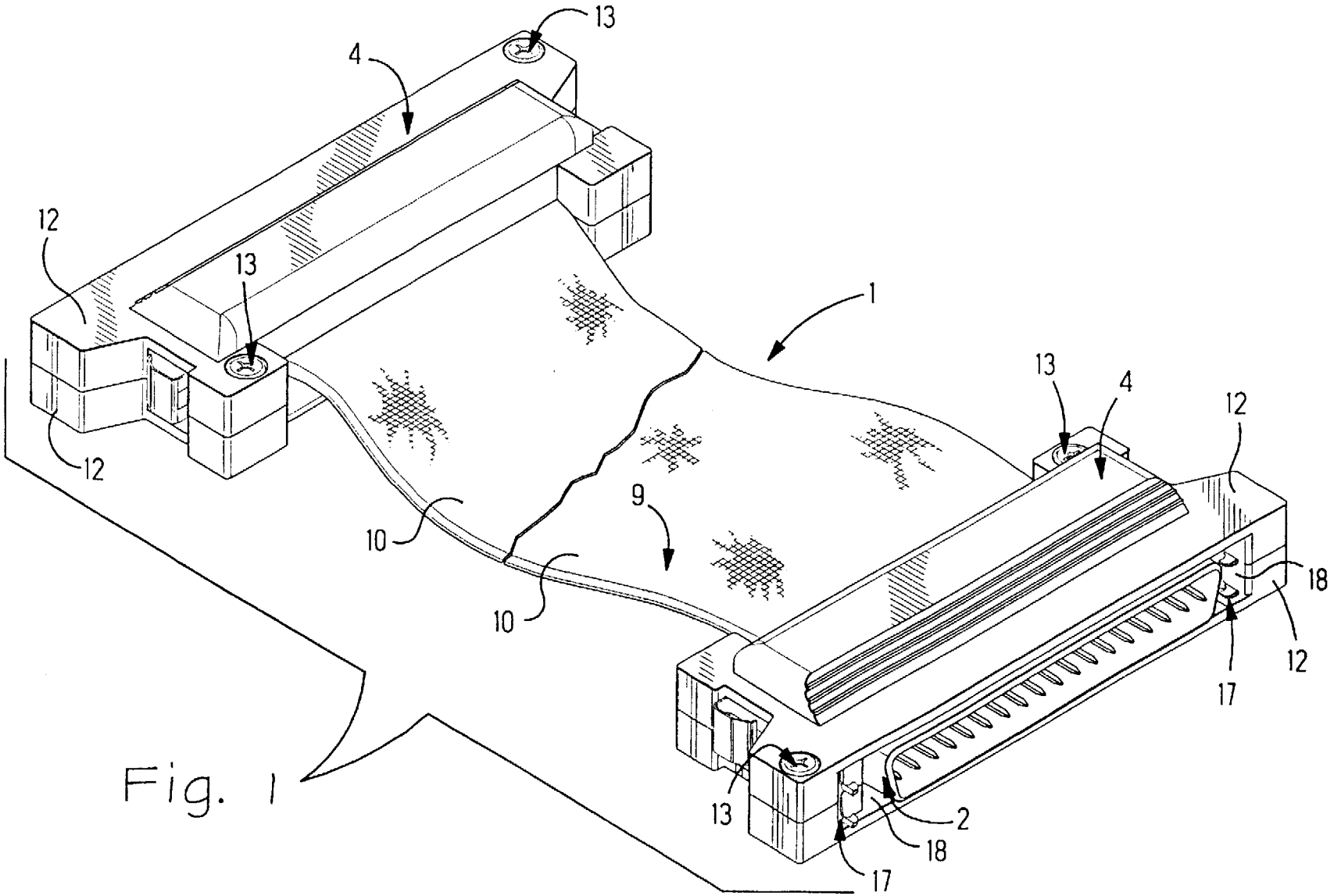
FIG. 1 is an isometric view of opposite ends of a cable assembly with insulated conductors shown broken away in the middle and electrical connectors terminating the opposite ends.
Figure 2:
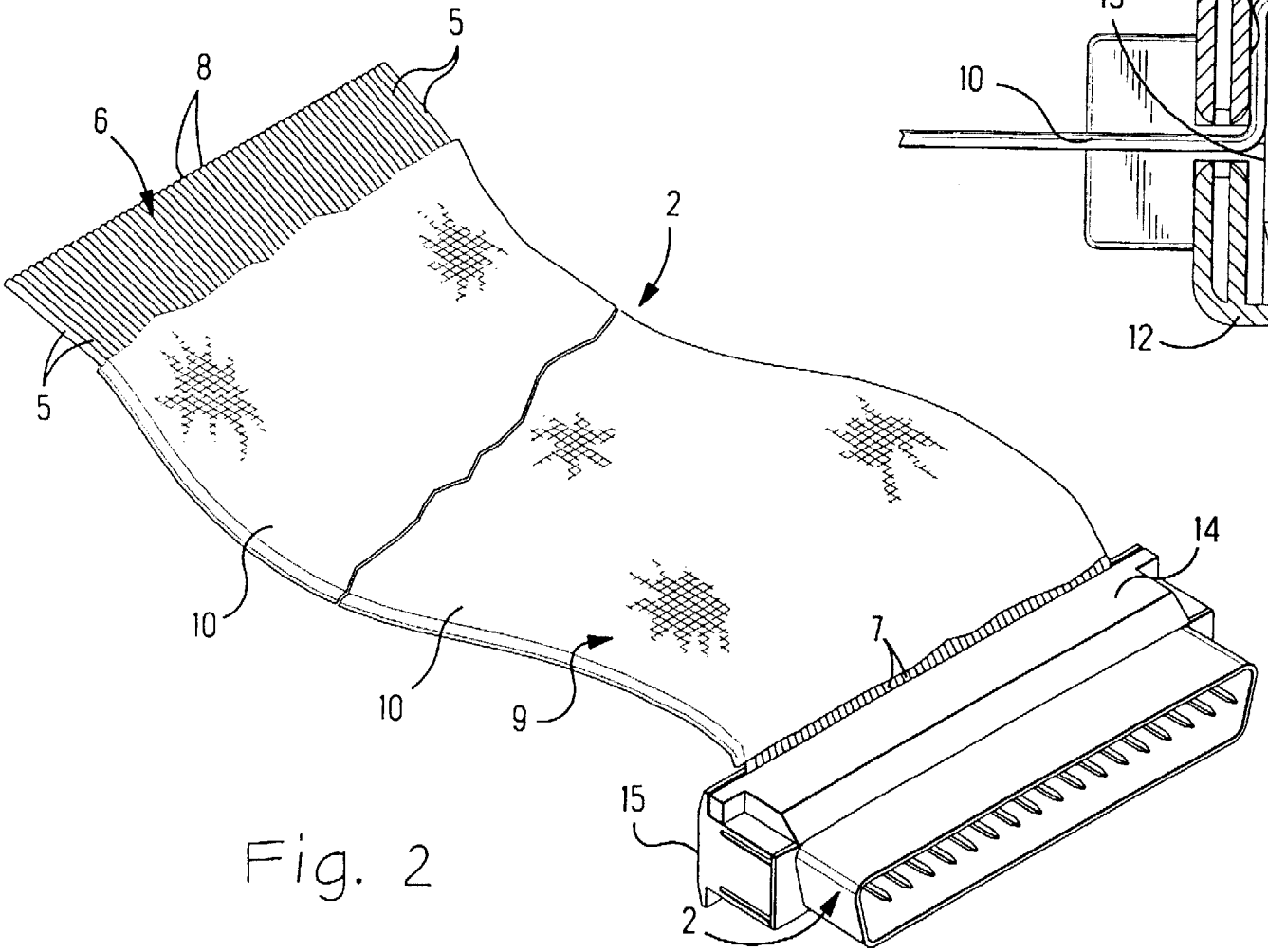
FIG. 2 is an isometric view of opposite ends of a cable assembly with insulated conductors shown broken away in the middle, together with an electrical connector terminating one of said opposite ends.
Figure 4:
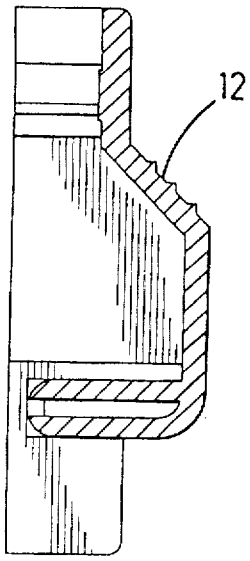
FIG. 4 is a section taken along the line 4—4 of FIG. 7.
Figure 5:
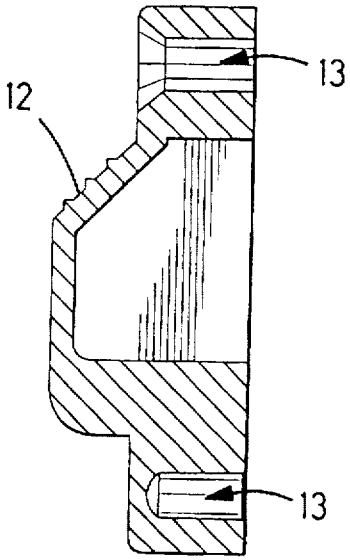
FIG. 5 is a section taken along the line 5—5 of FIG. 7.
Figure 6:
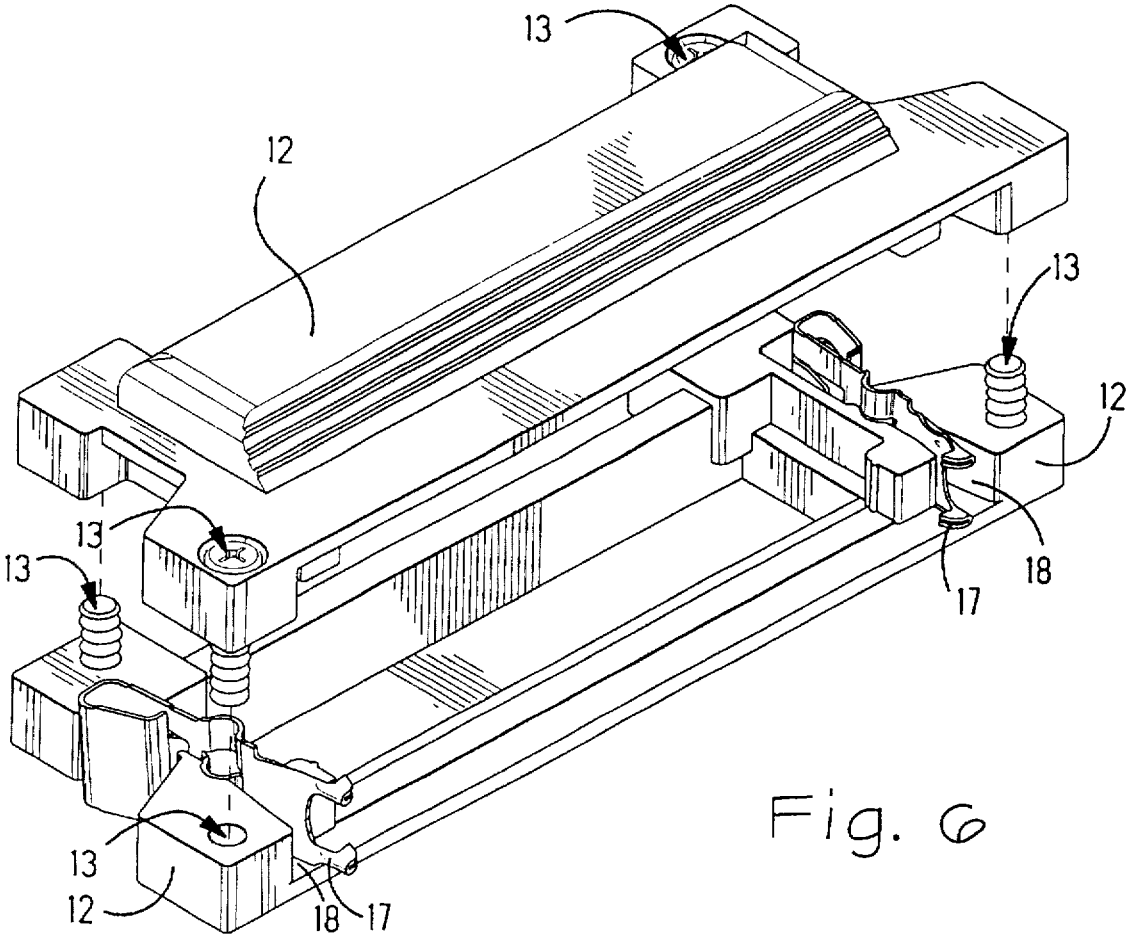
FIG. 6 is an isometric view of a pair of conducting shells.
Figure 7:
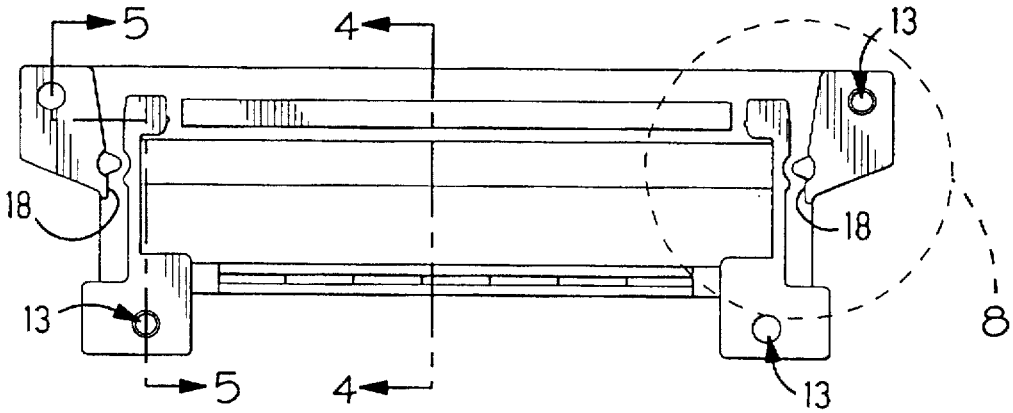
FIG. 7 is a plan view of an interior of one of the shells shown in FIG. 6.
Figure 8:
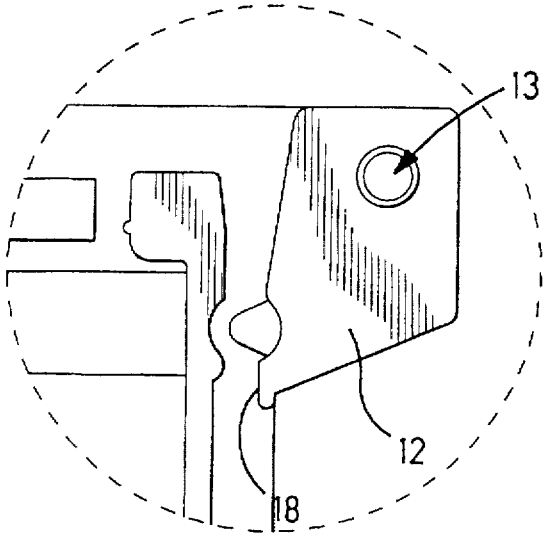
FIG. 8 is a fragmentary view of a portion of one of the shells outlined by a broken line in FIG. 7.
Figure 9:
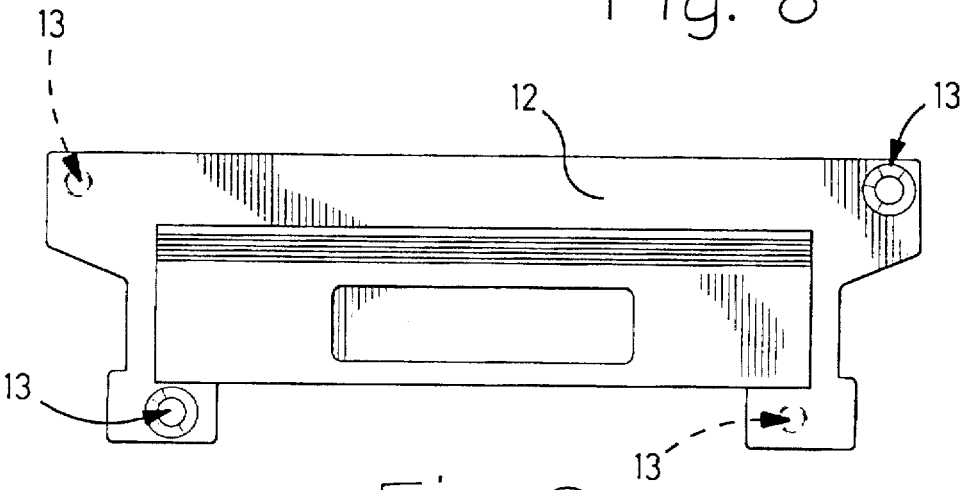
FIG. 9 is a plan view of an exterior of the shell as shown in FIG. 7.

With reference to FIGS. 1 and 2, a cable assembly (1) comprises, an insulating housing (2), a termination cover (4) assembled, in a termination position, with the housing 2 to close over multiple insulated conductors (5) that comprise an electrical cable (6). The insulated conductors 5 can be separate from one another or joined side by side in a ribbon cable construction. The housing 2 and termination cover 4 comprise an electrical connector.

Further details of the housing 2 and the termination cover 4 are disclosed in U.S. Pat. No. 5,122,079, incorporated herein by reference. According to the U.S. Patent, insulation displacement, electrical contacts in the housing 2 terminate respective insulated conductors 5 when the termination cover 4 is in the termination position wherein, the termination cover 4 is assembled and latched to the housing 2. Thereby, the termination cover 4 and the housing 2 terminate the insulated conductors 5. The insulated conductors 5 are said to be terminated by and with the termination cover 4 and the housing 2.

To make a jumper type cable assembly 1, opposite ends (7, 8) of the insulated conductors 5 are terminated with respective combinations of termination covers 4 and housings 2. In FIG. 1, opposite ends 7, 8 are terminated by respective termination covers 4 and housings 2. Alternatively, FIG. 2, one combination of a termination cover 4 and a housing 2 terminate the conductors 5 at collective, first ends 7, while the opposite collective ends 8 are available for termination of the conductors 5 by other electrical connections, for example, solder connections.

With reference to FIGS. 1 and 2, the cable assembly 1 further comprises, an electrical shield (9). The shield 9 of the cable assembly 1 further comprises, a flexible, conducting wrapper (10) encircling the insulated conductors 5 where the insulated conductors 5 project from the assembled termination cover 4 and the housing 2. The wrapper 10 is constructed from a fabric that is conducting and is available from Monsanto Company, St. Louis Mo., U.S.A., under the trademark FLECTRON. The wrapper 10 is cut to a desired length and is wrapped around the conductors 5. A seam (11) is joined, for example, by conductive adhesive or by being sewn.

Figure 3:
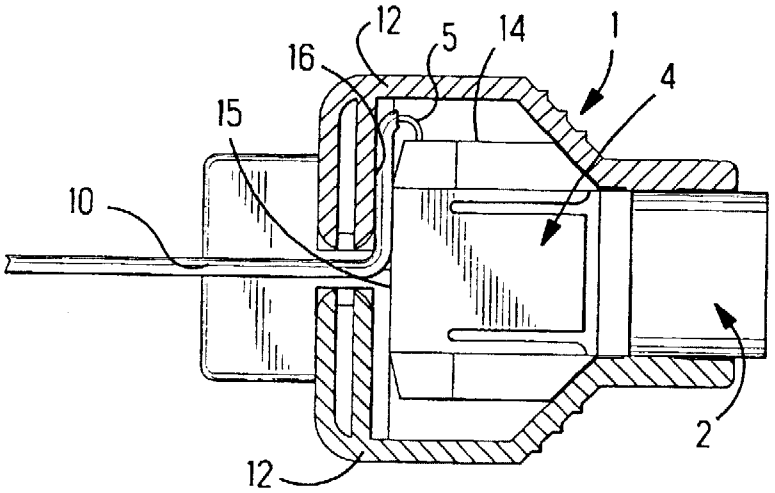
FIG. 3 is a fragmentary view in section of a terminated end of a cable assembly as shown in FIG. 1 or as shown in FIG. 2, together with shells enclosing an electrical connector and establishing a shield for the connector and insulated conductors terminated by the connector.

The shield 9 of the cable assembly 1 further comprises, conducting shells (12), FIGS. 1 and 3, also known as backshells, secured to each other. With reference to FIGS. 4–7, the shells are of hermaphroditic construction, secured to each other with fasteners (13), for example, threaded fasteners or posts press fit into sockets. The shells 12 are shown closing over the assembled termination cover 4 and the housing 2 and the insulated conductors 5 protruding from the termination cover 4 and the housing 2. In FIG. 3, the insulated conductors 5 and the wrapper 10 are shown being clamped by the shells 12 to establish an electrical connection between the wrapper 10 and said shells 12. Each of the shells 12 is of unitary construction, for example, die cast Zinc.

As shown in FIGS. 2 and 3, the insulated conductors 5 project from between the assembled termination cover 4 and the housing 2. The insulated conductors 5 project from a side (14) of the assembled termination cover 4 and the housing 2. The insulated conductors 5 and the wrapper 10 are routed between, and are clamped between, a rear surface (15) on the termination cover 4 and an interior surface (16) on at least one of the shells 12, to establish an electrical connection between the wrapper 10 and the shells 12. To enhance the electrical connection, the termination cover 4 compresses the wrapper 10 against at least one of the shells 12.

As shown in FIGS. 1 and 6–8, the cable assembly 1 further comprises, at least one conducting fastener (17) mounted in aligned recesses (18) in the shells 12 for coupling to, and for electrical connection with, a fastener coupling portion of a mating electrical connector. Further details of the fastener 17 is disclosed in U.S. Pat. No. 4,621,885. Thus the cable assembly 1 is capable of establishing an electrical connection of the shield 9 through the fastener 17, when the fastener 17 is coupled in a known manner with a mating electrical connector.

An advantage of the invention resides in a shield 9 for a cable assembly 1 constructed by a wrapper 10 of conducting fabric enclosing a cable 6, and conducting back shells 12 that clamp the wrapper 10 and enclose an insulating electrical connector 3, 4 that terminates the cable 6.

What is claimed is:

1. A cable assembly comprising:

an insulating termination cover assembled with an insulating housing to terminate multiple insulated conductors comprising an electrical cable, the insulated conductors projecting from between the assembled termination cover and the housing, a conducting wrapper encircling the insulated conductors where the insulated conductors project from between the assembled termination cover and housing, conducting shells secured to each other, the shells closing over the assembled termination cover and housing, the insulated conductors and the wrapper being routed between the termination cover and said at least one of the shells, the insulated conductors and the wrapper being clamped by the shells to establish an electrical connection between the wrapper and said shells wherein, the termination cover compresses the insulated conductors and the wrapper against at least one of the shells, and at least one conducting fastener mounted in the shells for coupling to, and for electrical connection with, a fastener coupling portion of a mating electrical connector.

2. A cable assembly comprising:

a termination cover assembled with an insulating housing and with insulated conductors of an electrical cable, and comprising an electrical connector terminated to the insulated conductors, the insulated conductors projecting from between the assembled termination cover and the housing, a conducting wrapper encircling the insulated conductors where the insulated conductors project from between the assembled termination cover and housing, conducting shells secured to each other, the shells closing over the assembled termination cover and housing, the insulated conductors and the wrapper being routed between, and being clamped between, the termination cover and said at least one of the shells to establish an electrical connection between the wrapper and said conducting shells.

3. A cable assembly comprising:

a termination cover assembled with an insulating housing and insulated conductors of an electrical cable, and comprising an electrical connector terminated to the insulated conductors, the insulated conductors projecting from between the assembled termination cover and the housing, a conducting wrapper encircling the insulated conductors where the insulated conductors project from between the assembled termination cover and housing, conducting shells secured to each other, the shells closing over the assembled termination cover and housing, and the termination cover compressing the wrapper against said one of the shells to enhance an electrical connection between the wrapper and the shells.

4. A cable assembly comprising:

a termination cover assembled with an insulating housing and insulated conductors of an electrical cable, and comprising an electrical connector terminated to the insulated conductors, the insulated conductors projecting from between the assembled termination cover and the housing, a conducting wrapper encircling the insulated conductors where the insulated conductors project from the assembled termination cover and housing, conducting shells secured to each other, said shells closing over the assembled termination cover and housing, the insulated conductors and the wrapper being routed between, and being clamped between, the termination cover and at least one of said shells to establish an electrical connection between the wrapper and said shells.

5. A cable assembly as recited in claim 4, and further comprising: the termination cover compressing the wrapper against said one of said shells to enhance an electrical connection between the wrapper and said shells.

6. A cable assembly comprising:

a termination cover assembled with an insulating housing and insulated conductors of an electrical cable, and comprising an electrical connector terminated to the insulated conductors, the insulated conductors projecting from between the assembled termination cover and the housing, conducting shells secured to each other, the shells closing over the electrical connector, the insulated conductors being routed between the electrical connector and at least one of the shells, and a conducting wrapper encircling the insulated conductors where the insulated conductors are routed between the electrical connector and said at least one of the shells, and the insulated conductors and the conducting wrapper being clamped between the electrical connector and said at least one of the shells to establish an electrical connection between the conducting wrapper and said at least one of the shells.

7. A cable assembly as recited in claim 6 wherein, the termination cover compresses the wrapper against said at least one of the shells to enhance the electrical connection.

8. A cable assembly as recited in claim 6 wherein, the wrapper has a seam, and the seam is joined.

* * * * *